US005740925A

United States Patent [19]

Crismon, Sr. et al.

[11] Patent Number: 5,740,925

[45] Date of Patent: Apr. 21, 1998

[54] PHONE BOOK CART

[76] Inventors: Frederick H. Crismon, Sr.; Robert W. Crismon, both of 424 N. Muleshoe Rd., Apache Junction, Ariz. 85219

[21] Appl. No.: 538,915

[22] Filed: Oct. 5, 1995

[51] Int. Cl.[6] ..... A47F 7/00

[52] U.S. Cl. ..... 211/43; 211/42; 248/447

[58] Field of Search ..... 211/42, 43; 248/444.1, 248/447

[56] References Cited

U.S. PATENT DOCUMENTS

| | | | |
|---|---|---|---|
| 1,277,544 | 9/1918 | Carre | 211/42 |
| 1,561,156 | 11/1925 | Greedy | 211/42 |
| 1,910,207 | 5/1933 | Freeman | 211/42 X |
| 2,494,382 | 1/1950 | Faulkner et al. | 211/43 X |
| 2,501,608 | 3/1950 | Lyons | 211/42 X |
| 2,527,277 | 10/1950 | Schade | 211/40 |
| 2,784,522 | 3/1957 | Bergman | 248/447 |
| 3,174,626 | 3/1965 | West | 211/42 |
| 3,228,648 | 1/1966 | Tils | 211/43 X |
| 3,487,945 | 1/1970 | Barham | 211/43 |
| 3,857,492 | 12/1974 | Michaelis et al. | 211/42 |
| 4,241,962 | 12/1980 | Ryan | 248/447 X |

FOREIGN PATENT DOCUMENTS

| | | | |
|---|---|---|---|
| 1203315 | 1/1960 | France | 248/447 |

*Primary Examiner*—Robert W. Gibson, Jr.

[57] ABSTRACT

A furniture device to store telephone directory books and the like, providing easy user access. Books of various size and thickness are attached to brackets connected to a pivot rod. When in the book hanging down position, the printed spine information is visible through a window in the bracket. When pivoted up, the book comes to rest in an open position on top of the cart. Caster wheels of the cart permit transportation of the attached books from one office place of use to another.

1 Claim, 2 Drawing Sheets

PHONE BOOK CART

BACKGROUND

1. Field of the Invention

The Phone Book Cart relates to the storage, easy user access, and transportation of telephone directories from one office to another by way of a hand cart to which the books are attached.

2. Description of Prior Art

Most telephone booths include a device used to store and make available a telephone directory book for use. This art form (example classification 312/233) is for devices permanently attached to a stationary telephone booth and the like. No prior art was found where a telephone directory or any other type of book hangs from a swivel bracket and is part of a furniture cart.

Many geographic areas require multiple telephone directory books to make up a complete set for business use. In metropolitan areas, the number of directories can be significant, weighing more than 30 pounds. In practice, telephone white and yellow page directory sets are generally shared by business employees. The frequent search for a specific directory can result in unnecessary personal frustration and lost employee production time.

The storage of telephone directories is also a universal business environment problem. It is almost impossible to store a telephone book on its unsupported edge without book ends because:

a.) the spine binding is glued, not sewn;

b.) the light weight cover material is not reinforced;

c.) the directory contains thin, inexpensive paper pages.

And, when one directory of a set supported by book ends is removed, the remaining directories generally fall down.

Delivered as a set, individual directories often become scattered about the office and are difficult to find. Multiple directories are not easily moved from office to office. Sets are found stacked on a table or stored in a book case or drawer. Multiple books must often be handled before access to the desired book is gained.

It is not uncommon for individual workers within a business to store a complete directory set at their work station, out of sight of others. This can result in the purchase of more directories than were initially provided at no cost by the telephone company.

OBJECTS AND ADVANTAGES

Accordingly, objects and advantages of our invention are:

(a) directories are stored within a mobile cart, eliminating the need of personal directory sets or search for books;

(b) title information printed on the book spine is readily visible to identify the content of each book;

(c) large and small books may be positioned side by side in any order, regardless of individual book spine width;

(d) caster wheels permit movement of the cart and its directory contents from one office or home location to another;

(e) the user will simply swing the selected book up on its bracket pivot, rotating the book up into an open position;

(f) in the open position, the book will lay flat on a sturdy base for reference, note taking and page turning;

(g) snap in book retainer wires permit easy removal of outdated directories and quick installation of new books.

The above objects and advantages of the Phone Book Cart also apply when it is used to store other frequently referenced book items such as purchasing catalogs, programming manuals and engineering data books. Further objects and advantages will become apparent from a consideration of the drawings and ensuing description.

DRAWING FIGURES

FIG. 1 shows all parts and a phantom telephone directory book.

FIG. 2 illustrates the directory retained by a bracket.

FIG. 3 is the bracket in the closed book hanging position.

FIG. 4 is the same bracket in the pivoted up open book position.

FIG. 5 illustrates the directory spine view window and spacer.

| Reference Numerals In Drawings | |
|---|---|
| 10 | side panel |
| 11 | caster support bracket |
| 12 | caster wheel |
| 13 | rod, side panel support |
| 14 | rod, book hanging position support |
| 15 | rod, book open position support |
| 16 | rod, bracket pivot |
| 17 | retainer nut, inside |
| 18 | retainer cap, outside |
| 19 | book bracket |
| 19-A | book bracket, book hanging position |
| 19-B | book bracket, book open position |
| 20 | bracket pivot hole |
| 21 | book retainer wire hole |
| 22 | spine view window |
| 23 | flexible "Z" shaped book retainer wire |
| 23-A | "Z" bend at each end of book retainer wire |
| 24 | bracket spacer |
| 25 | holes, optional stop |
| 26 | straight flexible book retainer wire |

DESCRIPTION OF DRAWINGS

In FIG. 1 a telephone directory book is attached to a book bracket 19 by inserting a flexible book retainer wire 23 into a book retainer wire hole 21 in the bracket. When said book is not in use, the bracket as shown in 19-A positions the directory in the hanging book closed position. The orientation of bracket 19-B positions the directory in the book open position. The bracket provides a spine view window 22 for easy book content reference when in the hanging position. A Rod 13-16 is threaded at each end and connected to a side panel 10 using an inside retainer nut 17 and an outside retainer cap 18. Rod 13 provides support to the lower end of the side panels. Rod 14 provides a stop for the book when in the hanging position; Rod 14 may alternatively be inserted in a optional hole 25 to accommodate large or heavy books. Rod 15 provides a rest for the book when in the open position. Rod 16 provides a pivot when inserted through a bracket pivot hole 20. As brackets 19 are threaded onto rod 16, a bracket spacer 24 is also threaded between each bracket and both side panels, which keeps the books properly positioned. A caster wheel 12 is supported by a caster support bracket 11. FIG. 2 illustrates a "Z" type bend 23-A at both ends of wire 23 which secures the book to the bracket 19. Bend 23-A holds the book securely in place during pivot action and cart mobility. If the book has a wide spine or is heavy, up to three wires 23 can be used per bracket 19. A straight flexible book retainer wire 26 may be provided in place of wire 23. Wire 26 has a ninety degree bend at one end. The other end of Wire 26 is secured to the bracket by attaching a threaded wire nut which is not shown. FIG. 3, illustrates bracket 19-A in the book hanging position. FIG. 4, illustrates bracket 19-B in the book open position. Completed pivot action results in the book and bracket 19 resting on rod 15. In FIG. 5, the top view of bracket 19 illustrates how brackets are positioned apart by a spacer 24 when brackets and spacers are threaded onto pivot rod 16. Cutouts in bracket 19 reveal the directory spine information by way of a spine view window

SUMMARY OF THE INVENTION

Figure 1:
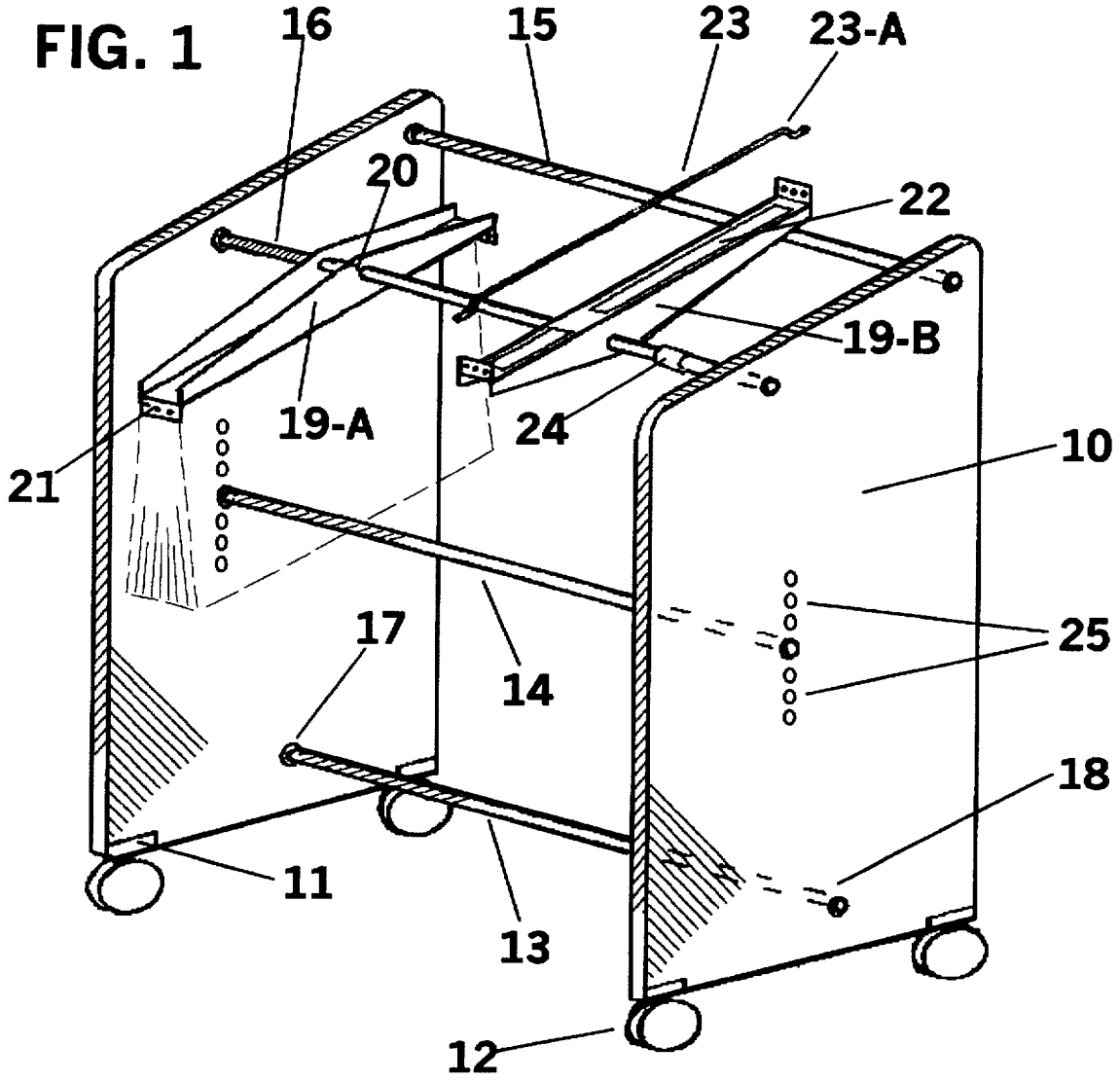
FIG. 1 to FIG. 5
Figure 2:
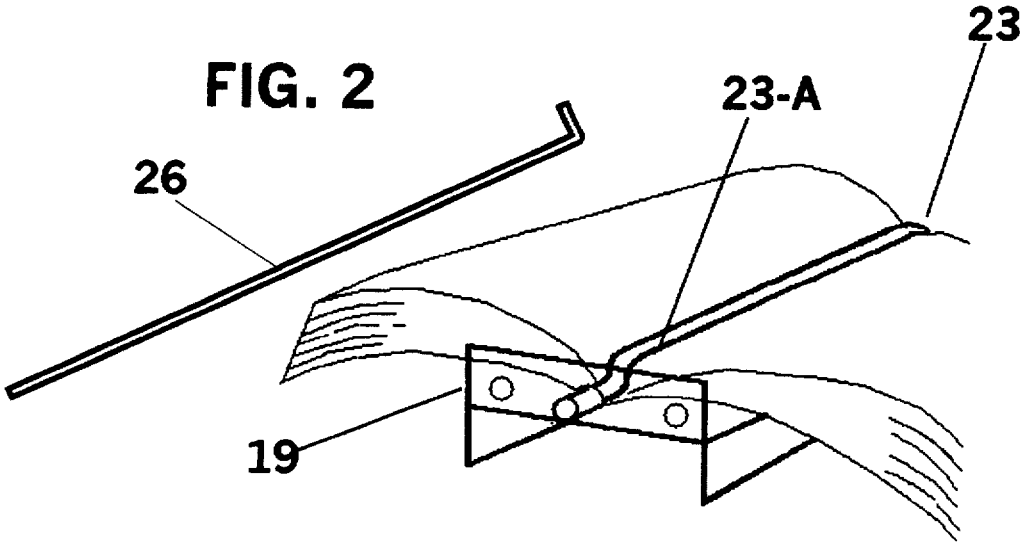
Figure 3:
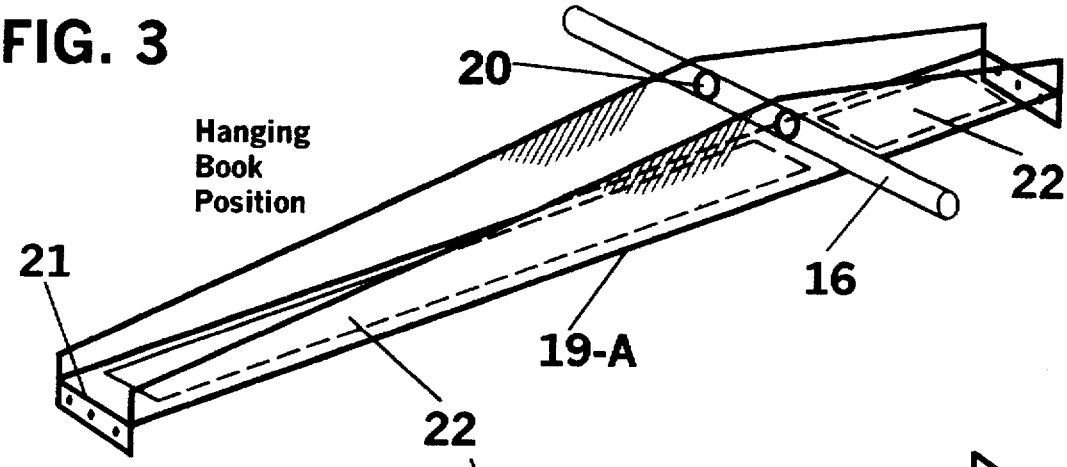
Figure 4:
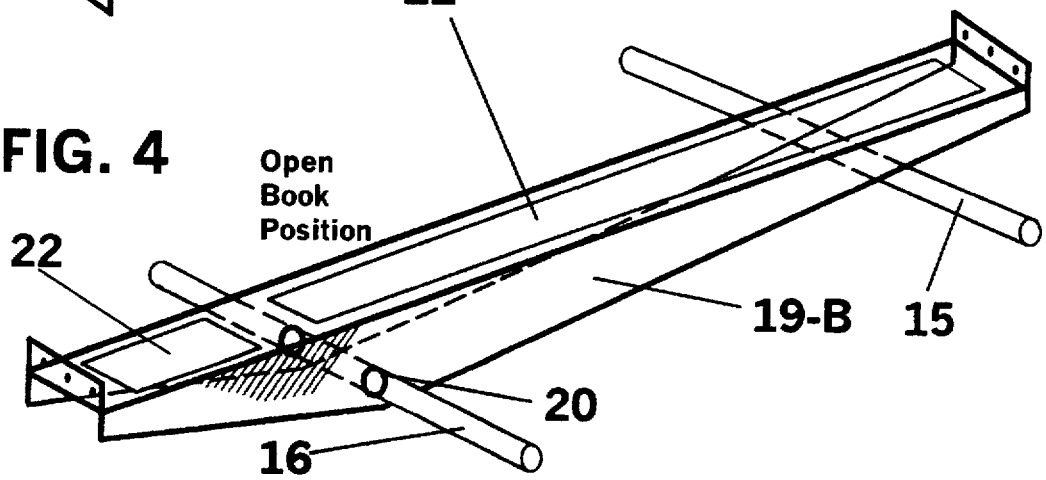
Figure 5:
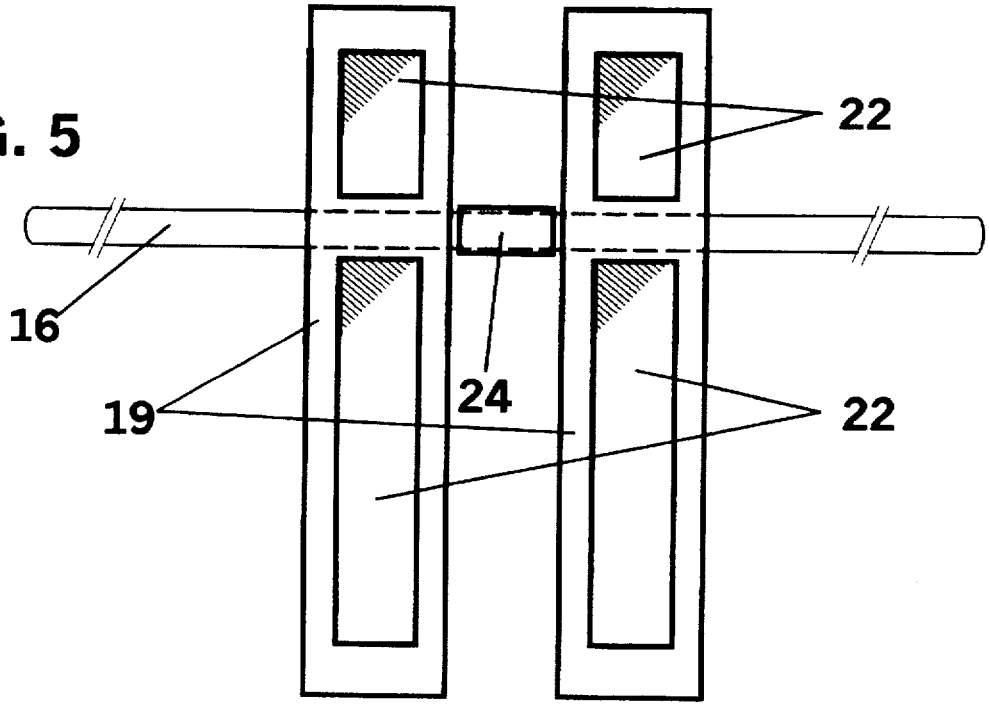

The Phone Book Cart is an esthetically pleasing furniture that will blend well with any business or home decor. It will store directories that can be moved as a set from place to place.

The Phone Book Cart includes a bracket that will hold a telephone directory book in a hanging position, revealing the book contents printed on its spine. Multiple brackets will be installed on a pivot rod. Directories of almost any thickness can be attached to a bracket. When a directory has been selected for use, it is pivoted up to an open book position on the top of the cart. Outdated directories will be replaced without the use of any tools.

The height of the Phone Book Cart makes directories readily available for reference when the user is in a seated or standing position. The cart assures that all books will be grouped together. Fewer directory sets will be required to service business needs. Directories will remain clean and not become unsightly. If a telephone or other type of book is extremely thick with a wide spine or the book weight can not be supported by one book retainer wire, additional retainer wires will be used to secure the book to the bracket.

The Phone Book Cart will also be used by people in work positions such as purchasing and engineering. These jobs require frequent use of books in addition to telephone directories.

Although the description above contains many specifications, these should not be construed as limiting the scope of our invention but as merely providing illustrations of some of the presently preferred embodiments. For example, the side panels may be of open tubular design; the bracket may be attached to a pivot rod in another manner, such as a hinge; a straight book retainer wire may be secured in the bracket holes using threaded nuts.

We claim:

1. A book holding bracket for rotatable mounting of a reference book, said book holding bracket comprising:

an elongated channel shaped member having two parallel sides and an interconnecting web, means in said two sides for rotatable mounting of said bracket to a support structure, book attachment means located at opposite ends of said channel shaped member for attaching a reference book to said bracket, and at least one opening in said interconnecting web, whereby information on the spine of a book attached to said bracket, may be viewed through said opening.

* * * * *